US010125769B2

(12) United States Patent
Sato et al.

(10) Patent No.: US 10,125,769 B2
(45) Date of Patent: Nov. 13, 2018

(54) SCROLL COMPRESSOR

(71) Applicant: MITSUBISHI HEAVY INDUSTRIES, LTD., Tokyo (JP)

(72) Inventors: Hajime Sato, Tokyo (JP); Takashi Sakuda, Tokyo (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 70 days.

(21) Appl. No.: 15/117,206

(22) PCT Filed: Jan. 5, 2015

(86) PCT No.: PCT/JP2015/000011
§ 371 (c)(1),
(2) Date: Aug. 8, 2016

(87) PCT Pub. No.: WO2015/122110
PCT Pub. Date: Aug. 20, 2015

(65) Prior Publication Data

US 2016/0341200 A1 Nov. 24, 2016

(30) Foreign Application Priority Data

Feb. 17, 2014 (JP) ..... 2014-027427

(51) Int. Cl.
*F01C 1/02* (2006.01)
*F01C 1/063* (2006.01)
(Continued)

(52) U.S. Cl.
CPC ..... *F04C 29/04* (2013.01); *F04C 18/0215* (2013.01); *F04C 18/0253* (2013.01);
(Continued)

(58) Field of Classification Search
USPC ..... 418/55.1–55.6, 101
See application file for complete search history.

(56) References Cited

U.S. PATENT DOCUMENTS 5,417,554 A 5/1995 Kietzman et al.
5,775,888 A 7/1998 Sakamoto et al.
(Continued)

FOREIGN PATENT DOCUMENTS

CN 1580564 A 2/2005
JP 63-123788 U1 8/1988
(Continued)

OTHER PUBLICATIONS

English Machine Translation by Espacenet JPH 09144673, Oct. 25, 2017.*
(Continued)

*Primary Examiner* — Mary A Davis
*Assistant Examiner* — Deming Wan
(74) *Attorney, Agent, or Firm* — Kanesaka Berner and Partners LLP

(57) ABSTRACT

A scroll compressor is provided that can cool a fixed scroll and an orbiting scroll effectively via cooling fins. A scroll compressor includes: a fixed scroll, an orbiting scroll that performs orbiting motion with respect to the fixed scroll and is combined with the fixed scroll so as to form, with the fixed scroll, a compression space to compress fluid; cooling fins that are provided on the back of the fixed scroll; and cooling fins that are provided on the back of the orbiting scroll. The cooling fins and the cooling fins are taller in a central portion than in the circumference of the central portion.

4 Claims, 4 Drawing Sheets

(51) Int. Cl.

| | |
|---|---|
| ***F03C 2/02*** | (2006.01) |
| ***F04C 2/02*** | (2006.01) |
| ***F04C 18/02*** | (2006.01) |
| ***F01C 21/06*** | (2006.01) |
| ***F04C 29/04*** | (2006.01) |
| *F01C 17/06* | (2006.01) |

(52) U.S. Cl.

CPC ..... *F04C 18/0269* (2013.01); *F04C 18/0276* (2013.01); *F04C 18/0284* (2013.01); *F01C 17/066* (2013.01); *F04C 2240/40* (2013.01); *F04C 2240/52* (2013.01)

(56) References Cited

U.S. PATENT DOCUMENTS

| | | | | |
|---|---|---|---|---|
| 6,190,145 | B1 * | 2/2001 | Fujioka | F04C 29/04 417/371 |
| 7,309,219 | B2 * | 12/2007 | Komai | F01C 21/10 418/101 |
| 7,377,759 | B2 * | 5/2008 | Ishizuki | F01C 17/06 418/55.1 |
| 2003/0053922 | A1 * | 3/2003 | Satoh | F04C 18/0215 418/55.1 |
| 2003/0161747 | A1 | 8/2003 | Satoh | |
| 2007/0065325 | A1 | 3/2007 | Takeuchi et al. | |
| 2011/0129362 | A1 | 6/2011 | Kameya et al. | |
| 2011/0200475 | A1 | 8/2011 | Hirata et al. | |

FOREIGN PATENT DOCUMENTS

| | | | | |
|---|---|---|---|---|
| JP | 64-53485 | U1 | 4/1989 | |
| JP | 6-249168 | A | 9/1994 | |
| JP | 06249168 | A * | 9/1994 | F04C 29/04 |
| JP | 9-144673 | A | 6/1997 | |
| JP | 10-502719 | A | 3/1998 | |
| JP | 2002-213376 | A | 7/2002 | |
| JP | 2002-257066 | A | 9/2002 | |
| JP | 3645339 | B2 * | 5/2005 | F01C 17/06 |
| JP | 2010-84592 | A | 4/2010 | |

OTHER PUBLICATIONS

English Machine Translation by Espacenet JPH06249168, Oct. 25, 2017.*

International Search Report in PCT Application No. PCT/JP2015/000011, dated Mar. 24, 2015.

Extended European Search Report in EP Application No. 15748912.1, dated Nov. 6, 2017, 8pp.

Office Action in CN application No. 201580007025.7, dated Mar. 8, 2017.

* cited by examiner

SCROLL COMPRESSOR

RELATED APPLICATIONS

The present application is a National Phase entry of International Application No. PCT/JP2015/000011, filed Jan. 5, 2015, which claims the benefit of priority from Japanese Patent Application No. 2014-027427, filed Feb. 17, 2014.

TECHNICAL FIELD

The present invention relates to an improvement of a cooling fin of a scroll compressor.

BACKGROUND ART

A scroll compressor includes a fixed scroll and an orbiting scroll. The fixed scroll and the orbiting scroll are both scrolls each including a disk-shaped end plate on one-face side of which a spiral wrap is provided. Such fixed scroll and orbiting scroll are made to face each other with their wraps engaged with each other, and the orbiting scroll is caused to perform orbiting motion with respect to the fixed scroll. Then, by reducing the volume of a compression space formed between both the scrolls with orbiting of the orbiting scroll, fluid in the space is compressed.

There is known a scroll compressor in which a large number of cooling fins are provided on the back of each of an end plate of a fixed scroll and an end plate of an orbiting scroll to dissipate heat of compression with the compression of fluid and frictional heat with rotations of components (e.g., Patent Literature 1 to Patent Literature 3). In particular, air cooling via cooling fins is employed in oil-free scroll compressors in which refrigerating machine oil mainly for lubrication is not used.

CITATION LIST

Patent Literature

Patent Literature 1: Japanese Utility Model Laid-Open No. 63-123788

Patent Literature 2: Japanese Utility Model Laid-Open No. 1-53485

Patent Literature 3: Japanese Patent Laid-Open No. 2002-257066

SUMMARY OF INVENTION

Technical Problem

A scroll compressor suctions fluid from the outer circumference side of scrolls, the fluid being to be compressed, and compression is performed gradually toward the center thereof. The compressed fluid is discharged from a port provided in the central portion of the fixed scroll to the outside. Since the temperature of the fluid rises with an increase in the degree of compression, the scrolls are to be exposed to a higher temperature as approaching to the central portion.

Thus, the present invention has an objective to provide a scroll compressor that makes it possible to cool a central portion of a scroll effectively.

Solution to Problem

A scroll compressor of the present invention that is made based on such an objective includes: a fixed scroll that includes a front on which a fixed-side wrap portion is provided, and a back on which a fixed-side cooling fin portion is provided; and an orbiting scroll that is combined with the fixed scroll so as to form, with the fixed scroll, a compression space to compress fluid, and includes a front on which an orbiting-side wrap portion is provided and a back on which an orbiting-side cooling fin portion is provided, wherein (one or both of) the fixed-side cooling fin portion comprising a plurality of fins and the orbiting-side cooling fin portion comprising a plurality of fins are each configured such that fins positioned in a central portion in a radial direction are taller than fins positioned in an outer circumferential portion around the central portion.

According to the scroll compressor of the present invention, the fins positioned in the central portion are taller than the fins positioned in the outer circumferential portion, and thus a heat-transfer area is large, which makes it possible to cool the central portion of the scrolls effectively.

In the scroll compressor of the present invention, one or both of the fixed-side cooling fin portion and the orbiting-side cooling fin portion can be configured to be taller in a stepwise manner or continuously as approaching to the central portion.

When the fixed-side cooling fin portion and the orbiting-side cooling fin portion are made to be taller continuously, it is possible to obtain cooling power corresponding to the degree of compression of the fluid, which has an advantage in the improvement of cooling power. In contrast, making the fixed-side cooling fin portion and the orbiting-side cooling fin portion taller in a stepwise manner is easy for manufacture including setting the heights.

In the scroll compressor of the present invention, it is preferable that one or both of the fixed-side cooling fin portion and the orbiting-side cooling fin portion are each configured such that front ends thereof are aligned with a single plane.

In such a manner, it is possible to avoid occupying an unnecessary space therearound, and for example, for a portion of a housing or the like corresponding to cooling fins, having a flat shape suffices.

To align the front ends of one or both of the fixed-side cooling fin portion and the orbiting-side cooling fin portion with a single plane, the wall thickness of (one or both of) a fixed-side end plate on which the fixed-side cooling fin portion is provided and an orbiting-side end plate on which the orbiting-side cooling fin portion is provided may be made smaller in the central portion than in an outer circumferential portion around the central portion.

Scroll compressors with this configuration include what is called a 3D scroll compressor, in which each a fixed-side wrap portion and an orbiting-side wrap portion is provided with level differences in an addendum and a basal portion so as to be taller in the central portion than in the outer circumferential portion.

Advantageous Effect of Invention

According to the scroll compressor of the present invention, fins positioned in a central portion are made taller than fins positioned in an outer circumferential portion, and thus a heat-transfer area is large, which makes it possible to cool the central portion of a scroll effectively.

DESCRIPTION OF EMBODIMENTS

Hereinafter, the present invention will be described in detail based on embodiments illustrated in the accompanying drawings.

First Embodiment

Figure 1:
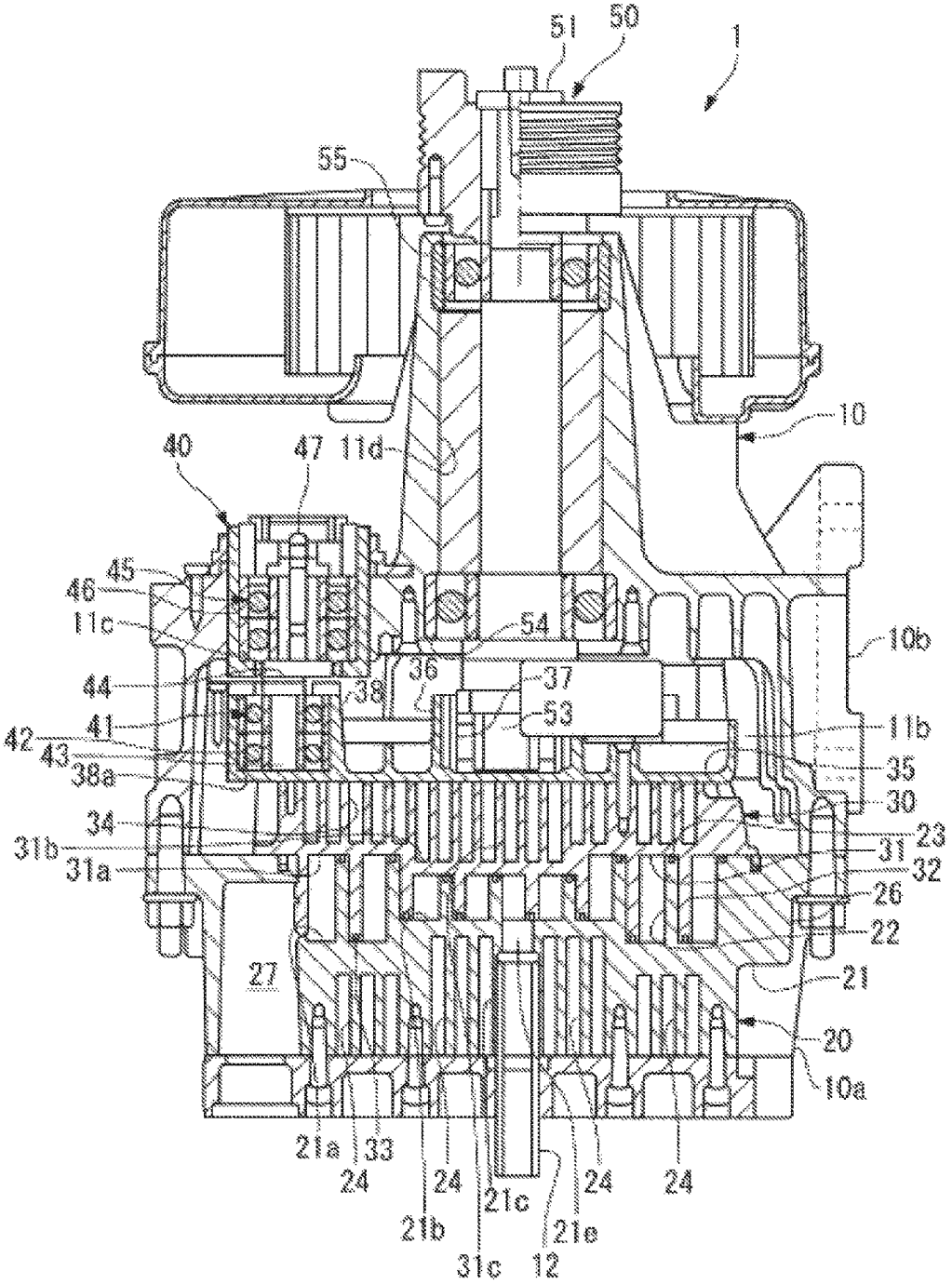
FIG. 1 is a vertical cross sectional view illustrating major parts of a scroll compressor according to a first embodiment of the present invention.
Figure 2:
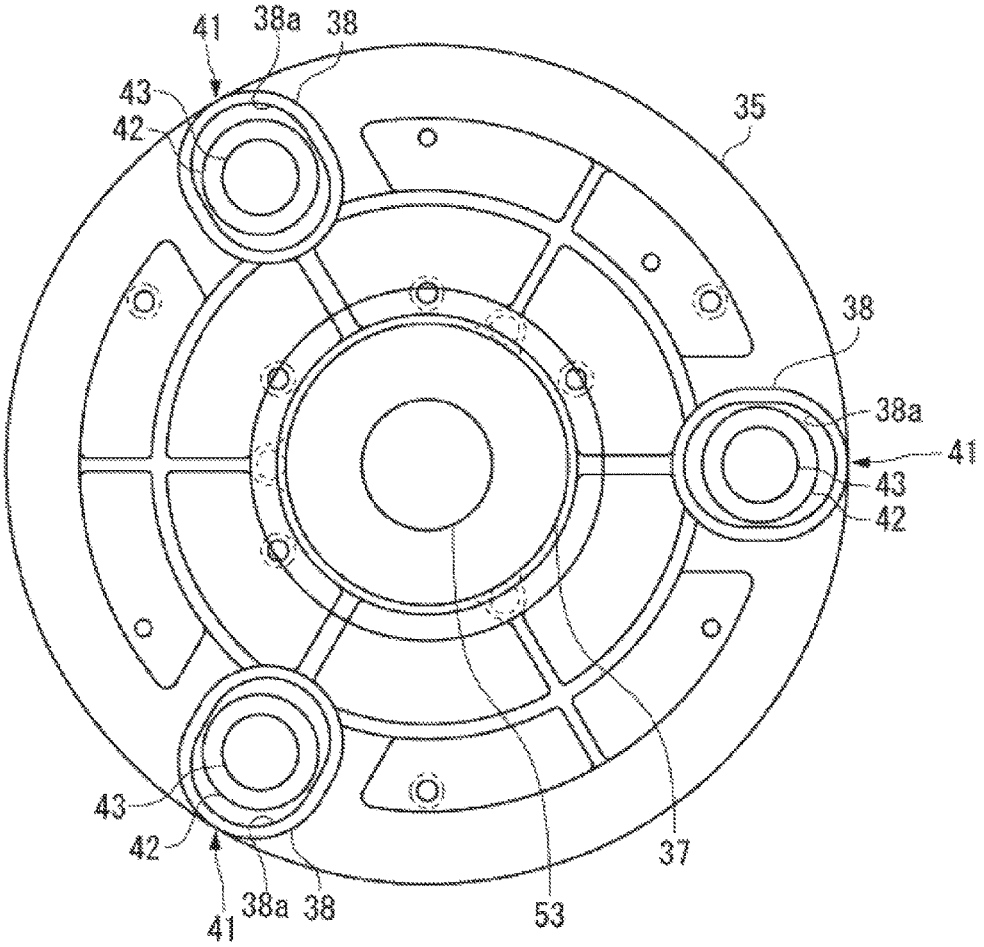
FIG. 2 is a drawing illustrating a crosscut of a first element portion of a self-rotation preventing mechanism of the scroll compressor in FIG. 1.

A scroll compressor 1 in the present embodiment includes, as illustrated in FIG. 1 and FIG. 2, a housing 10 that forms an outer shell of the scroll compressor 1, a fixed scroll 20 that is fixed to the housing 10, and an orbiting scroll 30 that is housed in the housing 10 in such a manner as to be able to orbit, as main components. These main components are formed of a metallic material such as an aluminum-based alloy, and an iron-based alloy.

The scroll compressor 1 is a scroll compressor of what is called a 3D scroll (Registered mark) that can provide a high compression ratio by employing a 3D compressing mechanism that compresses fluid not only in a circumferential direction but also in a height direction.

[Housing 10]

The housing 10 is, as illustrated in FIG. 1, a hermetically sealed container that is formed by a first housing 10*a* and a second housing 10*b*.

The first housing 10*a* is fixed to the fixed scroll 20 and houses therein cooling fins 24 of the fixed scroll 20. The first housing 10*a* includes a discharge port 12 that discharges, toward the outside, compressed fluid discharged from a discharge port 21*e* of the fixed scroll 20.

The second housing 10*b* houses and retains, in a housing chamber 11*b*, the orbiting scroll 30, self-rotation preventing mechanisms 40, and a driving shaft 50. The second housing 10*b* includes, in the housing chamber 11*b*, a housing chamber 11*c* that houses second elements 45 of the self-rotation preventing mechanisms 40, and a housing chamber 11*d* that houses the driving shaft 50 and a main bearing 54.

[Fixed Scroll 20]

The fixed scroll 20 includes, as illustrated in FIG. 1, an end plate 21 that is formed into a substantially disk shape, a wrap 22 that has a spiral shape and is provided on one-face side of the end plate 21, the cooling fins 24 that are provided on the other-face side of the end plate 21, and an outer circumferential wall 26 that surrounds the outermost circumference of the fixed scroll 20. For example, the fixed scroll 20 is cast in an aluminum alloy to be integrally formed into. The outer circumferential wall 26 is provided with a suction port 27 that suctions fluid to be subjected to compression. In addition, the outer circumferential wall 26 is exposed to the outside, constituting part of the housing 10. Note that, in the fixed scroll 20, a side on which the wrap 22 is provided is assumed to be front, and a side on which the cooling fins 24 are provided is assumed to be back.

In order to make the height of the wrap 22 on its inner circumference side lower than on its outer circumference side, the scroll compressor 1 of 3D type is provided on the end plate 21 with a lower stage portion 21*a* and a higher step portion 21*b*, and the wrap 22 formed on the lower stage portion 21*a* is made tall, and the wrap 22 formed on the higher step portion 21*b* is made short. Note that a level difference in the boundary between the lower stage portion 21*a* and the higher step portion 21*b* also appears on the back of the end plate 21, where a concave groove 21*c* is formed that surrounds the discharge port 12 and extends back toward the front.

The wrap 22 is provided at its front end with a tip seal 23 that has self-lubricating and is brought into contact with an end plate 31 of the orbiting scroll 30 to make a sealing.

The end plate 21 is formed with a discharge port 21*e* that penetrates both sides of the end plate 21, and fluid compressed by the fixed scroll 20 and the orbiting scroll 30 is discharged to the outside from the discharge port 12, through the discharge port 21*e*.

The end plate 21 is provided on the back with the plurality of cooling fins 24, namely a fixed-side cooling fin portion, that cools the fixed scroll 20 by allowing ambient air flowing in from an opening (not illustrated) formed in the housing 10 to pass through the cooling fins 24. Although, in the present embodiment, the plurality of plate-shaped cooling fins 24 are formed turning in the same direction, the plurality of cooling fins 24 can be provided, for example, radially from the center of the end plate 21. This is also true for the orbiting scroll 30.

The cooling fins 24 has different heights between the higher step portion 21*b* and the lower stage portion 21*a* surrounding the higher step portion 21*b*, and the cooling fins 24 provided in the higher step portion 21*b* corresponding to the center are tall.

[Orbiting Scroll 30]

The orbiting scroll 30 includes, as illustrated in FIG. 1, the end plate 31 that is formed into a substantial disk shape, a wrap 32 that has a spiral shape and is provided on one-face side of the end plate 31, and cooling fins 34 that are provided on the other-face side of the end plate 31. For example, the orbiting scroll 30 is cast in an aluminum alloy to be integrally formed into. Note that, in the orbiting scroll 30, a side on which the wrap 32 is provided is assumed to be front, and a side on which the cooling fins 34 are provided is assumed to be back.

The wrap 32 of the orbiting scroll 30 corresponds to the wrap 22 of the fixed scroll 20, and is formed so as to have a height that is smaller on its inner circumference side than on its outer circumference side. The end plate 31 is provided with a lower stage portion 31*a* and a higher step portion 31*b*, and the wrap 32 formed on the lower stage portion 31*a* is made tall, and the wrap 32 formed on the higher step portion 31*b* is made short. Note that a level difference in the boundary between the lower stage portion 31*a* and the higher step portion 31*b* also appears on the back of the end plate 31, where a concave groove 31*c* extends back toward the front.

The wrap 32 is provided at its front end with a tip seal 33 that has self-lubricating and is brought into contact with the front side of the end plate 21 of the fixed scroll 20 to seal a compression chamber.

The end plate 31 is provided on the back with the plurality of cooling fins 34, namely an orbiting-side cooling fin portion, that cools the orbiting scroll 30 by allowing ambient air flowing in from the opening (not illustrated) formed in the housing 10 to pass the cooling fins 34. The plurality of plate-shaped cooling fins 34 are formed turning in the same direction.

As with the cooling fins 24, the cooling fins 34 has different heights between the higher step portion 31*b* and the lower stage portion 31*a* surrounding the higher step portion 31*b*, and the cooling fins 34 provided in the higher step portion 31*b* corresponding to the center are tall.

The orbiting scroll 30 includes a bearing plate 35 that is fixed to the front end side of the cooling fins 34.

The bearing plate 35 includes a boss 36 that houses and fixes a bearing 37 in its central portion. The bearing 37 retained by the boss 36 supports an eccentric shaft 53 of the driving shaft 50.

In addition, the bearing plate 35 includes three bosses 38 that house first elements 41 of the self-rotation preventing mechanisms 40, in a circumferential direction at regular intervals, as illustrated in FIG. 2.

[Self-Rotation Preventing Mechanism 40]

The self-rotation preventing mechanisms 40 are self-rotation preventing mechanisms of a pin crank type and each includes the first element 41 and the second elements 45. The scroll compressor 1 includes three self-rotation preventing mechanisms 40 that correspond to the three bosses 38.

The first element 41 includes a bearing 42. The bearing 42 is formed by, for example, a ball bearing that includes an inner ring, an outer ring, and spherical rolling elements provided between the inner ring and the outer ring. The inner ring of the bearing 42 is fitted with a crank pin (first pin) 43 that constituted the first element 41 together with the bearing 42. The first element 41 is housed in the boss 38 of the bearing plate 35, and this boss 38 functions as a bearing housing of the bearing 42.

The second element 45 has a configuration similar to that of the first element 41 including two bearings 46, and a crank pin (second pin) 47 that is inserted into the inner ring of the bearing 46. The second elements 45 are housed and retained in the housing chamber 11*c* of the housing 10.

The crank pin 43 of the first elements 41 and the crank pin 47 of the second element 45 are integrally connected to each other via an eccentric shaft 44, and the crank pin 43, the crank pin 47, and the eccentric shaft 44 form an integrated crankshaft.

The boss 38 includes, as illustrated in FIG. 2, an inner wall 38*a*, which restricts the amount and direction of the displacement of the bearing 42. An opening of this inner wall 38*a* is different from a perfect circle and forms an elliptical shape that has a major axis in a radial direction of the bearing plate 35, and a minor axis in a circumferential direction of the bearing plate 35. That is, the boss 38 and the bearing 42 have such an anisotropy that makes an allowed amount of displacement of the bearing 42 (crank pin 47) large in the radial direction and small in the circumferential direction. Therefore, even if the orbiting scroll 30 thermally expands, the amount of displacement of the bearing 42 in the circumferential direction can be suppressed to be small while the displacement of the bearing 42 in the radial direction is absorbed. Therefore, it is possible to prevent the orbiting scroll 30 from twisting with respect to the fixed scroll 20.

[Driving Shaft 50]

The driving shaft 50 transmits rotary driving force of a driving source such as an electric motor, which is not illustrated, to the orbiting scroll 30.

As illustrated in FIG. 1, the driving shaft 50 includes, on its one-end side, a connection end 51 that is connected to the driving source, and at the other end, the eccentric shaft 53 that is retained by the bearing 37. The bearing 37 is retained by the bearing plate 35.

The driving shaft 50 is rotatably supported by the housing 10 with two bearings: the main bearing 54 and a sub bearing 55. The main bearing 54 supports the driving shaft 50 in the vicinity of the eccentric shaft 53, and the sub bearing 55 supports the driving shaft 50 in the vicinity of the connection end 51.

[Operation of Scroll Compressor 1]

Next, the operation of the scroll compressor 1 having the above configuration is as follows.

When driving shaft 50 rotates with the rotation of a driving source, which is not illustrated, the orbiting scroll 30 starts orbiting motion. Then, fluid suctioned from the suction port 27 is compressed in a crescent-shaped compression space that is formed by the wrap 22 and the wrap 32, and discharged from the discharge port 12 provided in the central portion.

While the scroll compressor 1 operates, the self-rotation preventing mechanisms 40 prevent the orbiting scroll 30 from performing self-rotation.

In addition, while the scroll compressor 1 operations, intake ambient air passes through the cooling fins 24 provided on the back of the fixed scroll 20 and cooling fins 34 provided on the back of the orbiting scroll 30, whereby the fixed scroll 20 and the orbiting scroll 30 are cooled.

[Advantageous Effects of Scroll Compressor 1]

Next, advantageous effects of the scroll compressor 1 will be described.

When fluid is compressed, the temperature thereof rises, and thus while the scroll compressor 1 is driven, the fixed scroll 20 and the orbiting scroll 30 are exposed to a high temperature to thermally expand. When the thermal expansion exceeds tolerance, there is the risk that an addendum of one of the scrolls is brought contact with a dedendum of the other scroll, inhibiting the orbiting scroll 30 from performing smooth orbiting motion.

However, since the fixed scroll 20 and the orbiting scroll 30 are cooled via the cooling fins 24 and the cooling fins 34, it is possible to suppress the thermal expansion. In particular, the scroll compressor 1 has a high cooling capacity because the cooling fins 24 and the cooling fins 34 respectively provided in the fixed scroll 20 and the orbiting scroll 30, the temperatures of which become high, are taller in the central portion than in a peripheral portion.

Since the scroll compressor 1 is a 3D-type scroll compressor, the back of fixed scroll 20 and the back of the orbiting scroll 30 are both recessed in the higher step portions 21*b* and 31*b* positioned in their centers. In the present embodiment, the recesses are utilized to make the cooling fins 24 and the cooling fins 34 in the relevant portions tall. Meanwhile, in the central portion and an outer circumferential portion therearound, the front ends of the cooling fins 24 are aligned with a single plane. This is also true for the cooling fins 34. Therefore, the scroll compressor 1 can be configured in such a manner as to align the positions of the front ends of each of the cooling fins 24 and 34 with one another from the center to the outer circumference while making the cooling fins 24 and 34 taller in the central portion. This indicates that, it is possible to avoid occupying an unnecessary space around the cooling fins 24 and 34, the unnecessary space being generated when the cooling fins 24 and 34 positioned in the central portion project so as to make the cooling fins 24 and 34 tall, and indicates that for example, for a portion of the first housing 10*a* corresponding to the cooling fins 24, having a flat shape suffice.

Second Embodiment

Although the first embodiment is about the 3D-type scroll compressor 1, the present invention is applicable to scroll compressors of types other than the 3D type, as illustrated in FIGS. 3A, 3B, 4A and 4B.

Figure 3A:
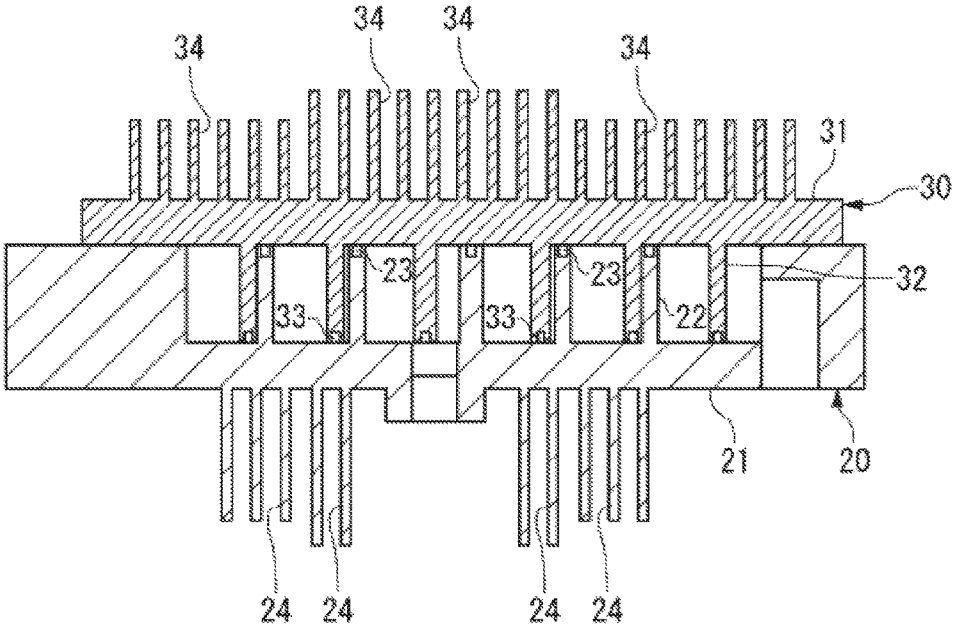
FIG. 3A and FIG. 3B are cross sectional views illustrating a scroll portion according to a second embodiment of the present invention.
Figure 3B:
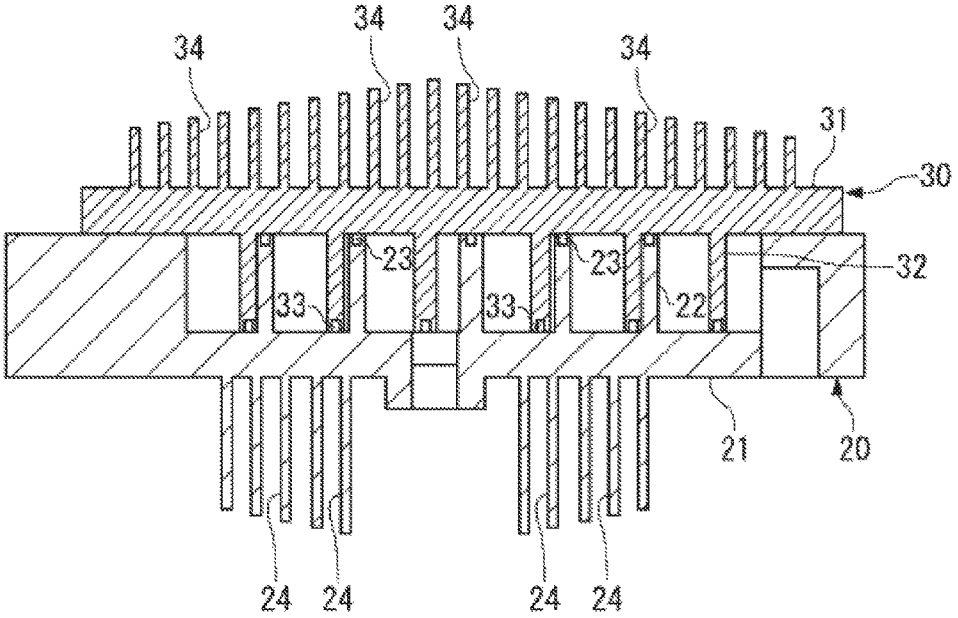

FIG. 3A and FIG. 3B illustrates examples in which cooling fins 24 and cooling fins 34 provided in the fixed scroll 20 and the orbiting scroll 30 including the backs of the end plate 21 and the end plate 31 that are both flat are formed to be taller in the central portion than in the outer circumference portion. Of the drawings, FIG. 3A illustrates an example in which the cooling fins 24 and the cooling fins 34 are made tall in a stepwise manner, and FIG. 3B illustrates an example in which the cooling fins 24 and the cooling fins 34 are made tall continuously. Note that, as an example of the stepwise manner, here is illustrated an example of two stages including a higher step and a lower stage, but the number of stages can be three or more.

Figure 4A:
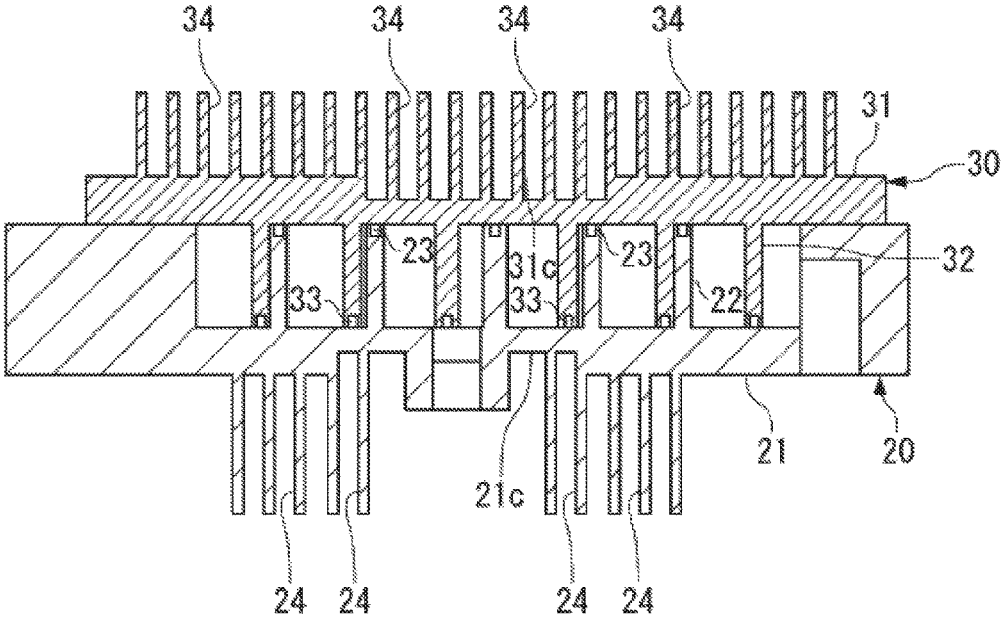
FIG. 4A and FIG. 4B are cross sectional views illustrating the scroll portion according to the second embodiment of the present invention.
Figure 4B:
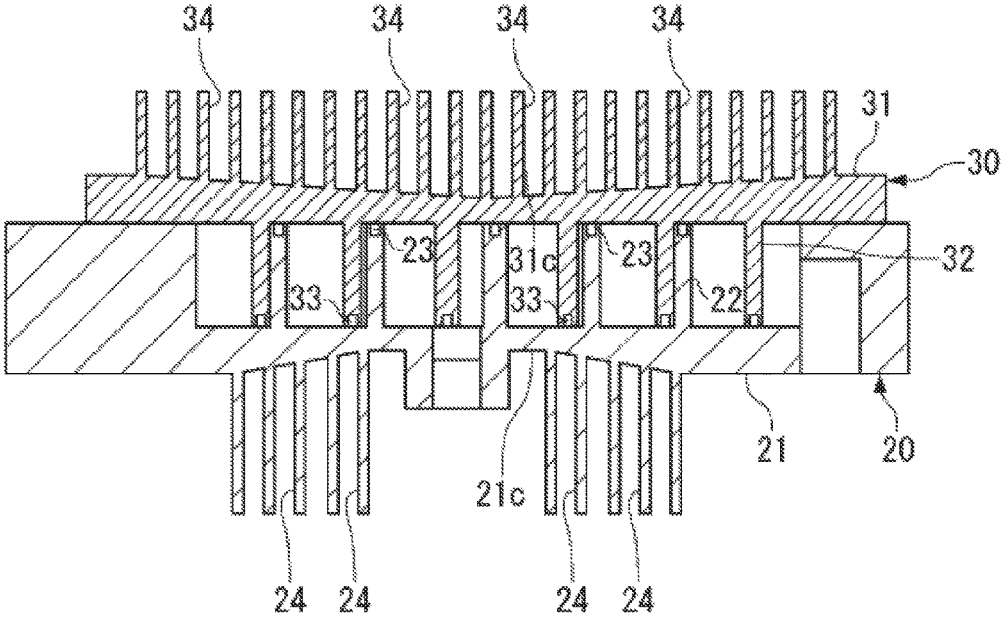

In the examples illustrated in FIG. 3A and FIG. 3B, positions of the front ends of each of the cooling fins 24 and the cooling fins 34 are uneven, but, as illustrated in FIG. 4A and FIG. 4B, the thicknesses of the end plate 21 and the end plate 31 can be reduced in a stepwise manner (FIG. 4A) or continuously (FIG. 4B) toward the central portion. By making, in such a manner, basal portions of the cooling fins 24 and the cooling fins 34 extend on the end plate 21's side and the end plate 31's side, it is possible to align the front ends of each of the cooling fins 24 and the cooling fins 34 with a single plane. With this configuration, it is possible to avoid occupying an unnecessary space which is generated when the cooling fins 24 and 34 positioned in the central portion project, and for example, for a portion of the first housing 10*a* corresponding to the cooling fins 24, having a flat shape suffices.

The preferred embodiments of the present invention have been described above, and the configurations described in the above embodiments may be selected or changed to the other configurations as appropriate, without departing from the gist and scope of the present invention.

For example, the embodiments described above have been made about the examples in which the heights of both of the cooling fins 24 of the fixed scroll 20 and the cooling fins 34 of the orbiting scroll 30 are made tall in the central portion, but the present invention allows for making only one of the fixed scroll 20 and the orbiting scroll 30 tall. In addition, the present invention is also applicable to the case where cooling fins are provided in only one of the fixed scroll 20 and the orbiting scroll 30.

Furthermore, the embodiments described above improve the cooling power of the central portion by making the cooling fins 24 and the cooling fins 34 in the central portion tall, and it is possible to improve further the cooling power of the central portion by adjusting the densities of the provision of the cooling fins 24 and the cooling fins 34, the plate thicknesses of the cooling fins 24 and the cooling fins 34, and the like.

Besides, the scroll compressor 1 is merely an example, and the present invention is widely applicable to scroll compressors including cooling fins.

The invention claimed is:

1. A scroll compressor comprising:

a fixed scroll that includes a front on which a fixed-side wrap portion is provided and a back on which a fixed-side cooling fin portion is provided; and an orbiting scroll that is combined with the fixed scroll so as to form, with the fixed scroll, a compression space to compress fluid and includes a front on which an orbiting-side wrap portion is provided and a back on which an orbiting-side cooling fin portion is provided, wherein both of the fixed-side cooling fin portion comprising a plurality of fins and the orbiting-side cooling fin portion comprising a plurality of fins are each configured such that the fins positioned in a central portion are taller than the fins positioned in an outer circumferential portion around the central portion, and both of the fixed-side cooling fin portion and the orbiting-side cooling fin portion are each configured such that front ends thereof are aligned with a single plane.

2. The scroll compressor according to claim 1, wherein one or both of the fixed-side cooling fin portion and the orbiting-side cooling fin portion are each configured to be taller in a stepwise manner or continuously as extending toward the central portion.

3. The scroll compressor according to claim 1, wherein one or both of a fixed-side end plate on which the fixed-side cooling fin portion is provided and an orbiting-side end plate on which the orbiting-side cooling fin portion is provided are each configured so as to have a wall thickness that is smaller in a central portion in a radial direction than in an outer circumferential portion around the central portion.

4. The scroll compressor according to claim 3, wherein each of the fixed-side wrap portion and the orbiting-side wrap portion is provided with level differences in an addendum and a basal portion so as to be taller in the outer circumferential portion than in the central portion.

* * * * *